US006526603B1

(12) United States Patent
Murphy

(10) Patent No.: US 6,526,603 B1
(45) Date of Patent: Mar. 4, 2003

(54) CONTAINER SYSTEM FOR DRAINING A URINARY LEG BAG

(75) Inventor: Kevin D. Murphy, Elko, MN (US)

(73) Assignee: Quality Assistive Devices, Inc., Elko, MN (US)

( * ) Notice: Subject to any disclaimer, the term of this patent is extended or adjusted under 35 U.S.C. 154(b) by 0 days.

(21) Appl. No.: 10/007,225

(22) Filed: Nov. 8, 2001

(51) Int. Cl.[7] ..... A61G 7/02
(52) U.S. Cl. ..... 4/480
(58) Field of Search ..... 4/144.1, 254, 480; 280/304.1; 604/323

(56) References Cited

U.S. PATENT DOCUMENTS 3,568,217 A * 3/1971 Anderson ..... 4/144.1
3,931,650 A * 1/1976 Miller ..... 4/480
4,874,387 A * 10/1989 Boone ..... 604/326
4,888,005 A * 12/1989 Dingeman et al. ... 280/304.1 X
5,002,541 A * 3/1991 Conkling et al. ..... 604/319
5,397,315 A * 3/1995 Schmidt et al. ..... 604/323
6,012,181 A * 1/2000 Johnson et al. ..... 4/480

* cited by examiner

*Primary Examiner*—Robert M. Fetsuga
(74) *Attorney, Agent, or Firm*—Philip M. Weiss; Weiss & Weiss

(57) ABSTRACT

An improved system that allows a disabled person in a wheelchair to automatically empty the contents of a urinary waste from a leg bag, without the aid of an attendant. The system comprises a pump mounted on the wheelchair, with the pump having an inlet port and a discharge port. The inlet port is connectable to the drain tube of the leg bag, and a discharge line is connected to the discharge port of the pump. The discharge line is connected to a receptacle for collecting fluid flowing through said discharge line.

7 Claims, 2 Drawing Sheets

CONTAINER SYSTEM FOR DRAINING A URINARY LEG BAG

FIELD OF THE INVENTION

The invention relates to urine collection devices, and more specifically to leg bags which are utilized by persons confined to wheelchairs. More particularly, the invention relates to a system for allowing an occupant of a wheelchair to automatically empty a leg bag without the aid of an attendant or assistant.

BACKGROUND OF THE INVENTION

Many types of people with disabilities use urine collection receptacles called leg bags in order to collect their urine. In a conventional leg bag, a drain tube is connected to the bag to permit emptying of the leg bag. Emptying of a leg bag is a frequent requirement because paraplegic and quadriplegic patients excrete exceptional amounts of urinary waste to compensate for deficiencies in other excretory processes. For paraplegic and quadriplegic patients in particular, this operation poses an enormous problem, due to limited mobility which prevents them from emptying the leg bag themselves. The assistance of an attendant or assistant is therefore required in order to empty the leg bag, thereby reducing the independence of the disabled person and may at times cause embarrassment for the individual.

An attempt to resolve this problem is disclosed in U.S. Pat. No. 3,931,650 to Miller. Miller discloses an apparatus which allows unassisted emptying of a leg bag by the occupant of the wheelchair. The apparatus includes a valve that is attached to the wheelchair, and which has an inlet that is connected to the drain tube of the leg bag. The outlet of the valve is connected to outlet tubing disposed beneath the wheelchair. The valve is manually actuatable by the occupant of the wheelchair through a lever that is easily accessible to the wheelchair occupant, or else automatically through a switch mounted on the wheelchair. In use, the wheelchair is moved to a position such that the drain tube is disposed over a floor drain, and the lever is actuated to open the valve, thereby allowing the urine in the leg bag to empty into the floor drain. When the leg bag is empty, the lever is again actuated to thereby close the valve. This apparatus relies upon gravity to empty the leg bag so that urine can only be emptied into floor located drains or into the ground itself which is unsanitary. In locations which do not have a floor drain, or else the floor drain is not easily accessible, this apparatus cannot be used.

U.S. Pat. No. 6,012,181 relates to a system which comprises a pump mounted on the wheelchair, with the pump having an inlet port and a discharge port. The inlet port is connected to the drain tube of the leg bag, and a discharge line is connected to the discharge port of the pump. The discharge line is mounted on the wheelchair, and a valve is provided which controls flow through the discharge line. The valve is selectively positionable between an open position in which flow is permitted through the discharge line and a closed position in which flow is prevented through the discharge line. With this system a user must find a drain, toilet or urinal to empty their leg bag once the leg bag is full.

Therefore there is a need for an improved system that allows a person who is confined to a wheelchair and who utilizes a leg bag, or the like, to empty the contents of the leg bag without the assistance of an attendant or frequent use of a toilet or urinal.

SUMMARY OF THE INVENTION

The present invention provides an improved system that allows a disabled person in a wheelchair to automatically empty the contents of a bodily waste collection receptacle, such as a leg bag, without the aid of an attendant. Since the waste can be emptied without the aid of an attendant, the disabled gains some measure of independence, freedom and privacy, as well as removing a barrier to work, education, etc., and costs are reduced since an attendant is not needed as frequently. Further, the system of the present invention is specifically designed to allow emptying of waste at locations not permitted by conventional systems, thereby further increasing the independence of the disabled person. It is an object of the present invention to provide an automated system for emptying the leg bag when it is full. It is an object of the present invention to use a float or sensor to tell the device when the leg bag is full so that the system automatically empties the leg bag into the receptacle. It is an object of the present invention for a user to be able to empty their own leg bag whenever necessary wherever they are in a discreet and sanitary manner without the use of a bathroom.

It is an object of the present invention for urine to be pumped from a leg bag into a receptacle attached to the wheel chair. It is an object of the present invention for the receptacle to hold at least one gallon of fluid. It is an object of the present invention for the receptacle to be hidden in a pouch or backpack. It is an object of the present invention for the pouch or backpack to hang from the wheelchair seat back or underneath the seat of the wheelchair. It is an object of the present invention to flush out each night the receptacle, pump and connecting tubular lines with a cleaning solution. It is an object of the present invention to provide a manual on/off switch or a puff switch to operate the device of the present invention.

In an embodiment in accordance with the invention, a system is provided for emptying urinary waste from a leg bag carried by an occupant of a wheelchair. The leg bag includes a drain tube, and the system comprises a pump mounted on the wheelchair, with the pump having an inlet port and a discharge port. The inlet port is connectable to the drain tube, and a discharge line is connected to the discharge port of the pump. Urine is pumped from the leg bag to a receptacle attached to the wheelchair.

In yet another embodiment in accordance with the present invention, an improvement to a wheelchair having an electrical power source disposed thereon is provided. The improved wheelchair includes a pump mounted thereon, with the pump having an inlet port and a discharge port. The inlet port is connectable to a receptacle for bodily waste, and the pump is driveable by an electric motor which is electrically connected to the electrical power source. A discharge line is connected to the discharge port of the pump.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION OF THE PREFERRED EMBODIMENT

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

Figure 1:
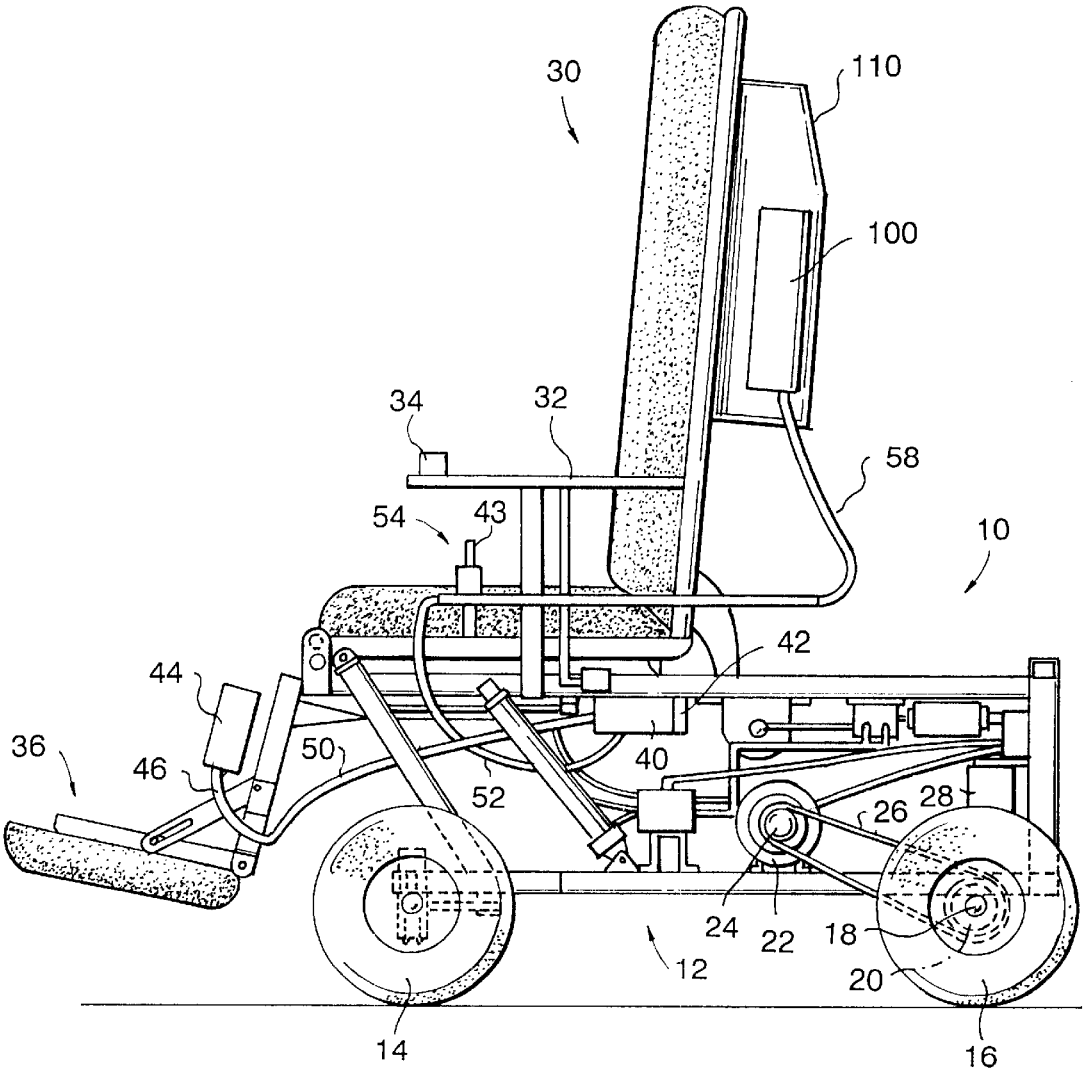
FIG. 1 is a side view of a wheelchair with the components of the system of the present invention mounted thereon.

Generally the system described herein allows a disabled person who utilize a bodily waste collection receptacle, such as a leg bag or the like, and who is confined to a wheelchair, to automatically empty the collection receptacle by themselves, without the aid of an attendant. With reference initially to FIG. 1, a wheelchair 10 suitable for use with the system of the present invention is illustrated. The wheelchair 10 generally includes a rigid framework 12 having a pair of front wheels 14 and a pair of rear wheels 16 connected thereto to enable the wheelchair 10 to roll along the ground. The rear wheels 16 are supported on a common axle 18 having a sprocket 20 fixed thereon. An electric motor 22 is mounted on the framework 12 and drives the rear wheels 16 via a gear mechanism 24 and drive chain 26 which engages the sprocket 20. Electrical power for the motor 22 is provided by a battery 28 that is mounted on the framework 12 and is electrically connected to the motor 22 in suitable fashion. The battery 28 is preferably a 12-volt battery, although the battery could supply higher or lower power if desired.

A seat assembly 30 is mounted on the top of the framework 12 upon which a person sits in use. The seat assembly 30 includes an arm rest 32 on each side thereof upon which the occupant of the wheelchair 10 can rest his/her arms during use. A control box 34 is mounted on one of the arm rests 32 and contains suitable control mechanisms, such as a joystick and switches, for controlling operation of the motor 22 and other equipment associated with the wheelchair 10. Connected to the front end of the framework 12 is a footrest assembly 36, upon which the occupant of the wheelchair places his/her feet during use.

The wheelchair 10 thus far described is a generally typical motorized wheelchair where the rear wheels are driven by an electric motor that is supplied with electrical power by a battery mounted on the wheelchair. The system of the present invention relies upon electrical power provided by the battery 28 on the wheelchair 10 to power a pump that is mounted on the wheelchair, with the pump being used to pump bodily waste, such as urine, from a collection receptacle, e.g. a leg bag, carried by the occupant of the wheelchair. However, it is to be realized that the system of the present invention could be used on a manually powered wheelchair which has a battery mounted thereon to provide power for operating the pump.

Figure 2:
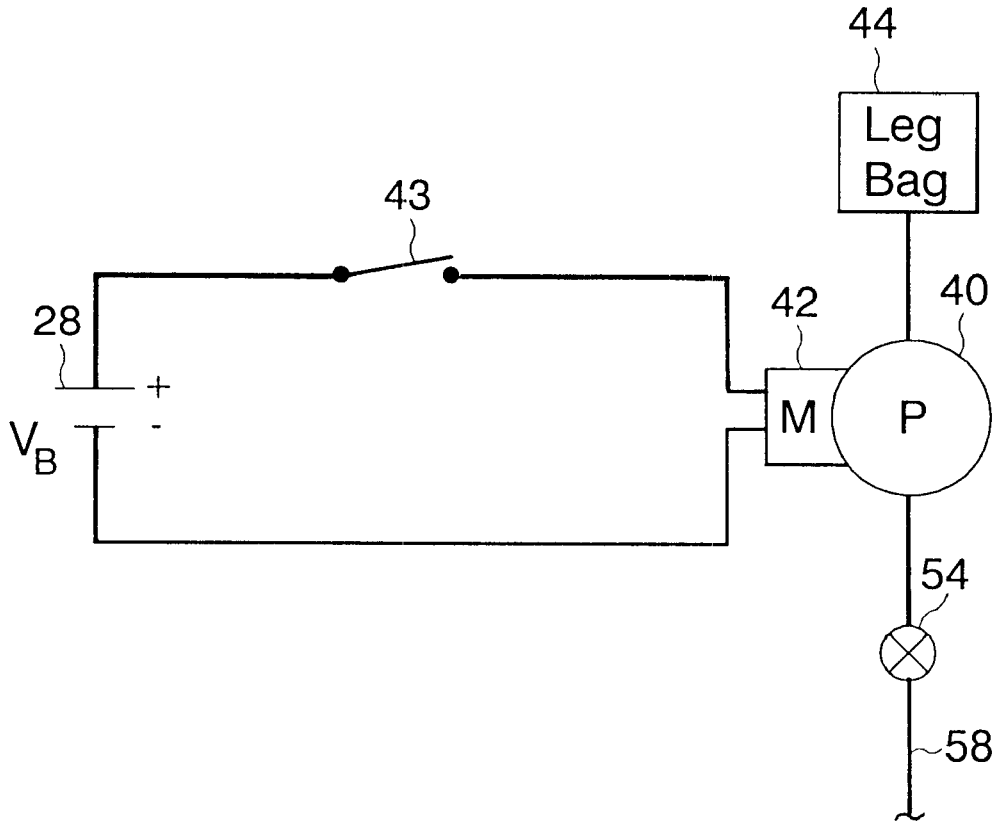
FIG. 2 is a schematic illustration of the electrical connection between the battery on the wheelchair and the motor which drives the pump.

With continued reference to FIG. 1, the system in accordance with the present invention includes a pump 40 that is mounted on the framework 12 of the wheelchair 10, such as underneath the seat assembly 30. The pump 40, which is shown schematically in the figures, is preferably driven by an electric motor 42 that is electrically connected to the battery 28 and which is operable by the electrical power supplied by the battery 28 as can be seen in FIG. 2. The pump 40, which can be a centrifugal or impeller type pump or a positive-displacement type pump, preferably includes an inlet port through which pumped fluid enters and a discharge port through which the pumped fluid is discharged from the pump. Although the pump 40 is described as being driven by an electric motor 42, the pump 40 could be hydraulically driven as well. One type of pump that is suitable for use with the invention is the 402 Series Midi-Fram, Single Piston Diaphragm Pump, made by SHURflo, of Santa Ana, Calif.

The motor 42 for driving the pump 40 is preferably activated by a switch 43 that is mounted at any convenient location on the wheelchair. In an alternative embodiment, the switch 43 can be disposed on one of the arm rests 32 of the wheelchair 10, such as on the control box 34 with the other wheelchair controls. The switch 43 can also be mounted at other locations on the wheelchair to allow manual activation thereof by a disabled person, so that the person can activate the pump 40 as desired without the aid of an attendant. A suitable switch for use with the invention is a momentary toggle switch that is spring loaded to the off position. Another type of switch that can be used is a puff switch for persons who cannot activate a toggle switch using their hand.

As described above, a disabled person occupying the wheelchair 10 relies upon a urine collection receptacle 44, commonly referred to as a leg bag, in order to collect urine. The leg bag 44 includes a drain tube 46 at the bottom thereof so that collected urine can be drained from the leg bag 44. A further tube 50 extends from the drain tube 46 to the inlet port of the pump 40. Thus, when the pump 40 is activated, urine is pumped from the leg bag 44, through the drain tube 46, through the tube 50, and into the pump 40.

Urine is pumped from discharge line 58 to a receptacle 100. The receptacle 100 could range in size but a preferred size is approximately one gallon. Receptacle 100 can be for example a rigid container or a flexible bag. In a further embodiment, the receptacle 100 can be a bag placed inside a rigid container with the bag being emptied during certain times. A one gallon container allows a four fold increase in the range of travel over standard leg bags. In a preferred embodiment, the receptacle 100 is hidden in a pouch or bag 110 that is attached to the wheelchair 10. In a preferred embodiment, the bag 110 can be attached to the wheelchair seat back.

The system of the present invention is flushed preferably once a day so that the cleaning solution is pumped into the receptacle 100 instead of into a toilet or urinal.

In a preferred embodiment leg bag 44 would contain a float or sensor which would indicate to the device when the bag 44 is full and automatically cause the pump 40 to fill the receptacle 100.

Quick connect/disconnect couplings can be used to secure the tube 50 to the inlet port of the pump 40, to secure the tube 52 to the outlet port of the pump 40, to thereby facilitate maintenance and repair operations on the system.

Once the receptacle 44 is empty, or when the person decides to stop emptying of the receptacle, the person merely releases the switch 43, thereby turning off the pump 40.

In an embodiment, the system of the present invention is installed on a wheelchair by attaching the pump 40 to the frame under the seat. The pump 40 can be mounted in any position except motor facing downward. The pump 40 should be mounted so as not to interfere with moving parts or recliner systems mounted to the chair. The switch to the tubing is installed on the side of the chair. The back pack 110 containing the receptacle 100 is secured to the back of the chair using straps provided by the back pack 110. The hose is secured to the leg of the chair. Hoses are cut to the proper length for the chair and attached to quick disconnect couplings. A wire harness is installed. In this embodiment a 12-volt system is used. This is attached to the first battery in the battery system. A user should make sure that the harness is tied up to the frame of the chair where it will not get pinched or damaged by any moving parts on the chair. The system is connected to the hose on the leg bag and open clamp on leg bag hose.

In an embodiment of the present invention a user flushes the system out at the end of each day with a solution of approximately 10 parts water to 1 part bleach. At least ½ gallon of this solution should be used to prevent accumulation of bacteria and to keep the system clean and working smoothly. An example for cleaning the device is as follows:

The receptacle located in the wheelchair pack is emptied.

The receptacle is replaced and the hose is hooked up to the container.

A cleaning bottle containing at least ½ gallon of the above solution is connected to the leg bag coupling.

The cap on the cleaning bottle is loosened so that it drains freely. Failure to loosen the cap will cause a vacuum in the bottle not allowing it to drain.

The switch is activated and solution is pumped into the receptacle contained in the back pack.

The receptacle is removed from the back pack and rinsed out.

The receptacle in the back pack is then replaced.

The system of the present invention thus allows a disabled person to empty a urine receptacle without the aid of an attendant.

While the system has been described as being used on a motorized wheelchair, the system could also be used on manually powered wheelchairs used by disabled persons who have use of their arms. In this case, a battery or other suitable supply of power would need to be mounted on the wheelchair for the specific purpose of powering the pump. Further, the switch could be located in any position that would allow activation by the person in the wheelchair, such as on one of the arm rests.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A system for emptying urinary waste from a leg bag comprising:

a leg bag;

the leg bag including a drain tube;

a wheelchair;

a pump mounted on the wheelchair, said pump having an inlet port and a discharge port, and said inlet port connectable to the drain tube;

a discharge line connected to said discharge port of said pump; and a receptacle attached to said wheelchair for collecting fluid flowing through said discharge line.

2. The system according to claim 1, wherein the pump is electrically driven, and the pump is electrically connected to an electrical power source disposed on the wheelchair.

3. The system according to claim 2, further including a switch for controlling flow of electricity to the pump and thereby controlling operation of the pump.

4. The system according to claim 3, wherein said switch is mounted on the wheelchair.

5. The system according to claim 3 wherein said switch is a manual on/off switch.

6. The system according to claim 1 wherein said receptacle is a one gallon receptacle.

7. The system according to claim 1 wherein said receptacle is hidden in a pouch or back pack which is attached to said wheelchair.

* * * * *